United States Patent [19]

Schurr

[11] Patent Number: 4,781,636

[45] Date of Patent: Nov. 1, 1988

[54] PORTABLE MARKER BUOY

[76] Inventor: Thomas Schurr, 3135 Hattan St., Sarasota, Fla. 33577

[21] Appl. No.: 35,455

[22] Filed: Apr. 7, 1987

[51] Int. Cl.[4] ..... B63H 21/52

[52] U.S. Cl. ..... 441/6; 441/26; 441/11; 441/16; 242/99

[58] Field of Search ..... 441/6, 7, 11, 13, 16, 441/23, 24, 25, 26, 28; 242/84.51 R, 84.51 A, 99

[56] References Cited

U.S. PATENT DOCUMENTS

| | | | |
|---|---|---|---|
| 385,323 | 6/1988 | Rust | 441/26 |
| 758,218 | 4/1904 | Roberts | 441/16 |
| 927,772 | 7/1909 | Brust | 441/26 |
| 2,722,019 | 11/1955 | Brock | 441/26 |
| 2,903,716 | 9/1959 | Zasada | 441/21 |
| 2,944,267 | 7/1960 | Kurtz | 441/26 |
| 2,957,446 | 10/1960 | Zasada | 441/11 |
| 3,005,215 | 10/1961 | Colt et al. | 441/26 |
| 3,089,156 | 5/1963 | Hamm | 441/25 |
| 3,196,469 | 7/1965 | Anthony | 441/25 |
| 3,487,485 | 1/1970 | Holm et al. | 441/26 |
| 3,597,778 | 8/1971 | Castelliz | 441/25 |
| 3,618,150 | 11/1971 | Anselmi | 441/16 |
| 3,631,550 | 1/1972 | Bullen | 441/25 |
| 3,875,602 | 4/1975 | Miron | 441/13 |
| 3,937,415 | 2/1976 | Prinz | 242/99 |
| 4,103,379 | 8/1978 | Wolfe | 441/11 |
| 4,107,804 | 8/1978 | Bennett | 441/24 |
| 4,144,606 | 3/1979 | McIntyre | 441/11 |
| 4,195,380 | 4/1980 | Higgs | 441/26 |

*Primary Examiner*—Sherman D. Basinger
*Assistant Examiner*—Edwin L. Swinehart
*Attorney, Agent, or Firm*—Dowell & Dowell

[57] ABSTRACT

The portable marine marker buoy having a transparent signal support housing which is carried by a float and is stabilized in the water by a depending weight assembly and which is restrained from drifting by an anchor which is deployed by an automatically locking anchor line dispensing reel assembly.

9 Claims, 2 Drawing Sheets

PORTABLE MARKER BUOY

BACKGROUND OF THE INVENTION

1. Field of the Invention

This invention is generally directed to floatable buoys which are utilized in marine environments to mark specific locations and specifically to a portable marking buoy which may be easily disassembled for storage and reassembled for use and wherein the buoy includes signal devices which may include a light source that is supported by a float that is maintained in general vertical position by a depending weight assembly. An anchor line is deployed from the buoy by an automatically locking dispensing reel in such a manner as to insure that the buoy retains its initial placement in the water after its deployment. The buoy of the present invention is also designed to insure rapid dispensing of the anchor line immediately upon the deployment of the buoy in the water to thereby insure the accurate marking of a location by enabling the dispensing reel handle to be removed during deployment to prevent its resistance to the rotary movement of the dispensing reel. When deployed in the evening hours, the buoy makes special provisions for housing chemiluminescent light sources and thereby avoids the use of batteries and/or electrical contacts which may otherwise become corroded or easily shorted out in aqueous and especially salt water environments. The overall structure of the buoy of the present invention is also designed to create a maintenance free and corrosive resistant structure which is assembled and disassembled without tools.

2. History of the Art

Over the years there have been numerous types and styles of marine buoys designed to serve various functions. Marine buoys or floatable markers are not only used to define safe channels of passage through waterways but are also utilized to mark specific locations such as to identify specific fishing spots, traps for marine life including crab pots and lobster traps, or to mark specific subsurface locations so that such locations may be readily relocated for future research, investigation and/or testing.

Generally, buoy markers which are used to identify safe passages through waterways are complicated structures which are not readily portable nor are they designed to be readily retrievable as it is the purpose of such markers to maintain a specific location regardless of the water conditions. Such markers, therefore, must be constructed to insure that they are visible during high and low tides alike and that they are also visible during periods of high storm waters. These structures, which may be referred to as channel markers, are generally designed to be permanently anchored and are therefore not portable and are placed in position by heavy anchoring devices such as cables and chains which maintain the buoy in the properly fixed location.

Buoys of the type which are normally utilized to mark location have been designed and constructed in various shapes and sizes depending upon the type of waters in which they are to be deployed or the purposes which they are to serve In U.S. Pat. No. 3,005,215 to Colt et al., there is disclosed a marker which is designed to be deployed either from water or air craft and is of a type which is submerged below the surface of a body of water until such time as the buoy is released by a time release mechanism. This type of buoy is utilized to insure that the buoy marker will be at the proper location on the water's surface at a given time to provide safe indication of passage or identification of a specific location. The time delay control allows the buoy to be retained in a specific anchored position until such time as it is necessary to be displayed. In a similar manner, U.S. Pat. No. 2,722,019 to Brock discloses a submersible buoy having a timing mechanism incorporated therewith for automatically releasing the buoy to allow a marker to surface at a predesignated time. Again, such buoys are utilized to provide a marking in a water channel only at predetermined times thereby maintaining the channel normally unmarked. Submersible and time releasable buoys generally find most use in military applications and are not suitable for private individuals. Timing mechanisms and subsurface releasing mechanisms are complicated and costly to manufacture and are therefore not adequate for everyday use.

In U.S. Pat. No. 3,487,485 to Holm et al., a deep ocean buoy assembly is disclosed which is of the type which is utilized to mark a specific location in deep ocean waters. A buoy of this construction generally includes elongated hollow pipe sections which may extend 20 to 60 feet or more in length. Each of the pipe sections is hollow and the sections are normally welded together to form a composite structure which floats vertically due to the air retained within the pipes and because of the buoyant device mounted on top of the pipe column. The pipe marker is maintained in a somewhat fixed position by a weighted anchor which is attached to a cable or anchor line attached to the bottom of the pipe column. Again, such enlarged structures are not suitable for use by individuals who desire to mark a specific location with respect to an underwater area or perhaps a marine trap of some description.

Another example of generally large floatable buoy markers which are anchorable in either shallow or deep waters is disclosed in U.S. Pat. No. 2,903,716 to Zasada. The mooring device for the buoy disclosed in Zasada utilizes an anchor line which is automatically dispensed until such time as the anchor engages the bottom of the body of water after which the line is locked in fixed relationship with respect to a float member which is tied to a separate buoy marker by means of a separate cable. As with many of the other prior art devices, such a structure is overly complicated and not portable. An anchor of the type described normally utilizes anchor weights in excess of 200 pounds. In addition, the component parts of the device include many metallic elements which are incorporated with the anchor reeling mechanism which elements would become corroded and fouled over a very short period of time.

An example of a smaller marking buoy which is specifically adapted for use by individual boatspersons or fishermen is disclosed in U.S. Pat. No. 3,089,156 to Hamm. The marking device or buoy in Hamm discloses a signal flag which is mounted directly to the frame of a reel which has a deployable weight or anchor windingly supported thereto so that the anchor may be deployed by releasing the handle and allowing the weight to fall by gravity until the anchor line is dispensed to a point where the weight engages the bottom of the surface of the body of water. Although this type of buoy offers an alternative for a floatable marker which may be utilized by individual boaters, the structure utilizes a floatable reel assembly that exposes the anchor line dispensing reel to the effects of any surface water turbulence. Also, the handle of the buoy will retard the dispensing of the anchor line as the handle will be resisted by the water especially as the handle is rotated to a point of non-entry with the water. Such interference with the dispensing of the anchor line will delay the full deployment of the anchor thereby allowing the buoy or marker to drift from its initial mark. The buoy also includes a brake mechanism for the reel which requires that the mounting frame for the reel be perfectly aligned with the reel in order to prevent the reel from becoming wedges to the frame during deployment of the anchor line and thereby further retarding complete deployment of the anchor. As the weight of the flag associated with the buoy is mounted in offset relationship with respect to the frame, there is possibility that the frame will bind against the reel and prevent total deployment of the anchor or otherwise allow the anchor line to be released after initial placement thereby permitting the buoy to float off its true mark. In addition to the foregoing, this buoy structure does not provide any night guidance as there is no provision for supplying a light source which may be utilized to mark a given area in hours of darkness.

The use of lighted buoys itself is well known in the art. However, buoys utilizing light sources generally utilize a DC powered light source connected to a battery supply carried by the buoy. In the event of any leakage of water into the buoy structure, the electrical contacts soon become corroded and the light source ineffective. Further, the light source itself may be subject to damage by heavy wave action or by handling of the buoy during periods of storage or deployment.

From the foregoing, although buoys have been designed to be of various sizes and shapes and have been specifically designed to include automatic reeling mechanisms and have incorporated stabilizing weights and floats together or in combination with various signal sources, most prior art buoy devices are not suitable nor satisfactory for use by individual boaters. Most prior art buoys are not easily disassembled for storage in compact areas and are not designed to be relatively free of any components which are corrodible upon exposure to water or which may interfere with rapid dispensing of the anchor as they permit the buoys to drift from their true mark. In addition, prior art lighted buoys which are portable in nature operate utilizing electrical circuitry which is easily damaged and therefore become inoperative during a very short period of use.

Some additional examples of prior art buoys and buoy markers include U.S. Pat. Nos. 927,772 to Brust; 2,957,446 to Zasada; 3,196,469 to Anthony; 3,597,778 to Castelltz and 3,631,550 to Bullen.

SUMMARY OF THE INVENTION

This invention is directed to a portable marker buoy of the type which may be utilized by individual boaters to mark a specific location in an aquatic environment and which includes a plurality of separable components which may be quickly joined into a unified body for easy deployment and which may be recovered and disassembled for storage without the requirement of any tools. The marker buoy includes at least one elongated pole means which is generally hollow and which is adapted to support a chemiluminescent light source which is selectively placed therein and which also may selectively support a signal flag of any general designation The pole element is carried by a float which is threadingly secured thereto. The float also supports an anchor line dispensing assembly which is threadingly secured thereto so as to be in axial alignment with the signal support post or pole which extends above the float. The float is maintained in a generally stable vertical position within the water by a weight assembly which is mounted so as to be in generally axial alignment with both the anchor line dispensing assembly, float and the signal support post or pole. The anchor line from the reel dispensing assembly passes through the weight assembly and includes an anchor or weight at the remote end thereof which is utilized to automatically deploy the anchor line by gravitational force as the buoy is placed in the water. The anchor line dispensing assembly includes a reel element having a plurality of teeth incorporated therewith which are selectively engagable with a flexible clicker element that controls the rate of descent of the anchor line during deployment. The clicker element provides an automatic stop to prevent further deployment of anchor line upon the anchor reaching the bottom of the body of water in response to the non-rotational movement of the reel element.

In order to insure that the anchor line is dispensed as quickly as possible when the buoy is deployed to insure an accurate mark, the crank arm which is normally utilized to reel in the anchor line is designed to be removably received on a spindle which supports the reel element for the anchor line dispensing assembly. The buoy is designed to be lightweight and is primarily constructed of PVC, ABS or other plastic tubing which may be transparent as in the case with the signal support post or pole with the float being preferrably formed of a durable plastic material which may be polyurethane or polystyrene foam. The entire buoy is constructed along a common vertical axis to facilitate the stabilization of the device and to prevent any interference with the anchor line and the dispensing mechanism by any motor craft passing adjacent to the buoy or marker.

It is a primary object of the present invention to provide a portable lightweight buoy marker which can be utilized by individual boaters to mark a specific location in the water and which allows the anchor line to be automatically played out or dispensed and then locked from further deployment upon the anchor reaching the floor of the body of water.

It is another object of the present invention to provide a portable buoy marker which is assembled from several components which are threadingly engagable with one another so as to form a composite buoy without the need for utilizing any tools or other equipment to assemble the buoy for deployment or to break apart the buoy for storage.

It is another object of the present invention to provide a portable buoy marker which provides a transparent housing elevated above the water surface in which a chemiluminescent light source may be selectively disposed in order to create a signal for hours of darkness so that a light source is created without the need for electronic circuitry or batteries which may be fouled by the presence of any water within the buoy.

It is another object of the present invention to provide a buoy which may be used either during hours of darkness or daylight and incorporates signal support means which may house a light source which may be chemiluminescent or some other type of low cost self-contained light and which also may support a separate flag for use during daylight hours.

Another object of the present invention is to provide an automatic anchor line dispensing assembly for controlling the deployment of the anchor line from a portable buoy wherein the reel is automatically locked in position when tension is released as the anchor engages the bottom of a body of water by the non-rotational movement of the reel which would normally during its rotation maintain the locking mechanism in a nonengaged and non-locked position so that the operation of the locking mechanism is totally responsive to the rotational movement of the anchor line dispensing assembly.

It is a further object of the present invention to provide a portable buoy marker for use in aquatic environments wherein the anchor line dispensing assembly for deploying the anchor line includes a crank handle which is easily removable prior to deployment of the buoy to thereby facilitate the rapid dispensing of the anchor line upon initial deployment of the buoy and which may be easily attached without tools in order to effect the reeling in of the anchor line when the buoy is being retrieved.

It is also an object of the present invention to provide a portable lightweight buoy marker which is inexpensive to manufacture and is generally free of any metallic components which may be corrodible or otherwise limit the life of the buoy.

A further object of the present invention is to provide a buoy marker having a balanced design wherein the separate components of the marker are assembled in end to end relationship along a generally common axis with the anchor line and wherein the weight of the anchor which is distributed through the anchor line is oriented along a common axis to thereby further insure the vertical stability of the marker during periods of deployment.

DESCRIPTION OF THE PREFERRED EMBODIMENT

Figure 1:
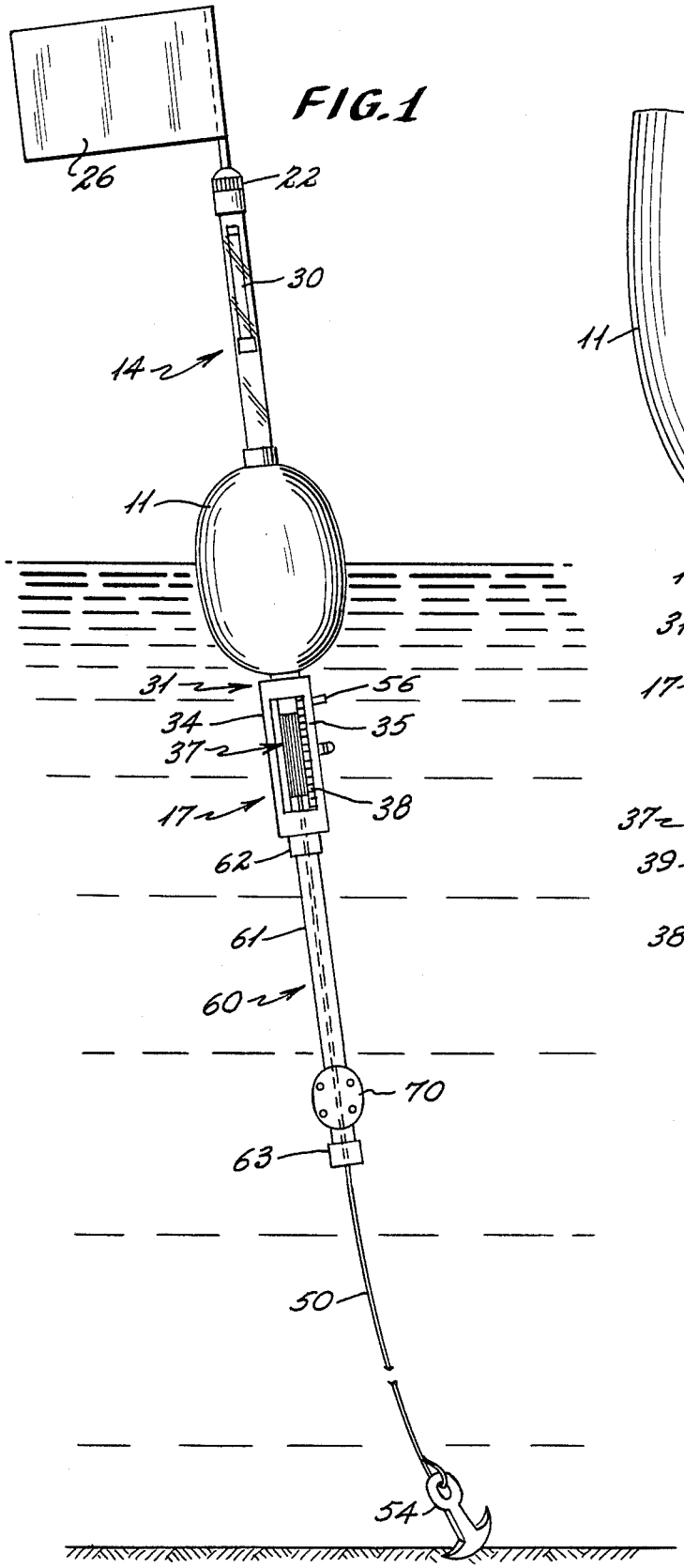
FIG. 1 is an illustrational view of the marker buoy of the present invention showing the anchor deployed in a body of water with the anchor line extended so that the anchor is in engagement with the bottom of the body of water.
Figure 2:
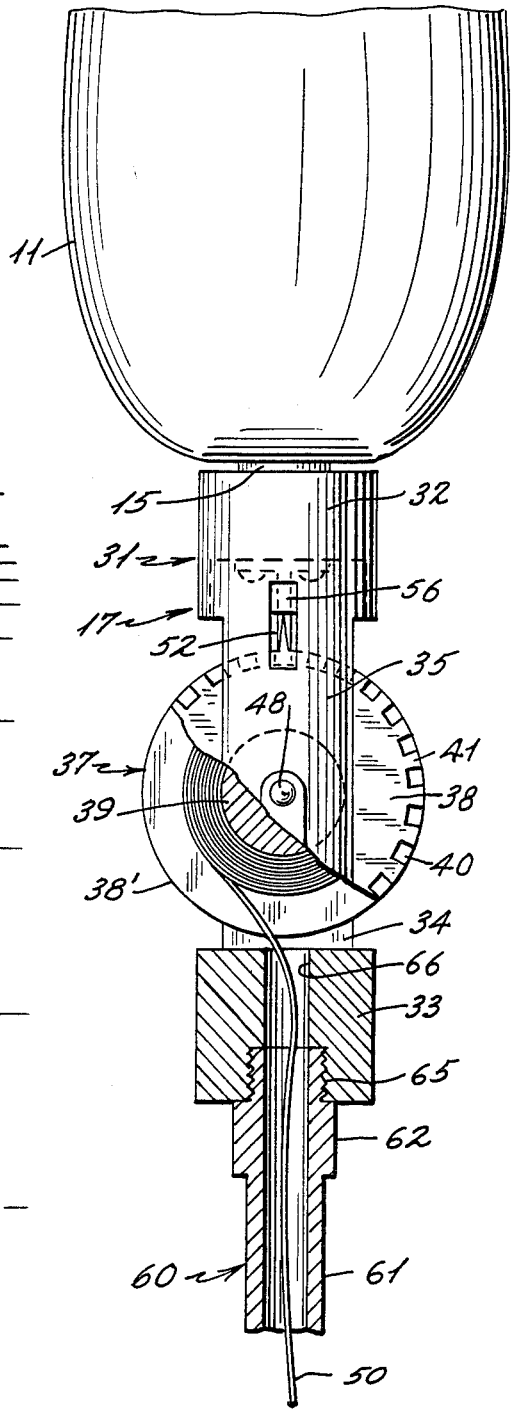
FIG. 2 is an enlarged plan view of the float and reel portion of the present invention having portions of the reel assembly broken away to show the extension of the anchor line through the weight assembly secured to the anchor line dispensing assembly.

With continued reference to the drawings, the portable marker buoy 10 of the present invention will be described in greater detail. The marker buoy includes a generally centrallized float member 11 which is formed of a floatable or hollow material which may be a plastic foam such as a polyurethane or polystyrene. An integrally formed threaded opening 12 extends inwardly from the upper central portion of the float 11 and defines a female threaded receptacle for selectively engaging the threaded end portion 13 of a signal support housing or tube 14. The lower end of the float 11 has an integrally formed and depending male threaded member 15 which is receivable within a female threaded portion 16 of an anchor line dispensing assembly 17.

The signal support housing or tube 14 includes generally transparent side walls 18 which are closed at the ends by cap portions 19 and 20. The closed end portion 20 includes the male threaded end portion 13 which is engagable within the female threaded sleeve 12 of the float 11. The upper end cap 19 also includes a threaded end portion 21 over which a closure cap 22 is threadingly received. A pair of aligned openings 23 and 24 are provided through the threaded end portion 21 and the cap 22 in order to permit the support rod 25 of a signal flag 26 to be inserted therethrough. The length of the support rod may vary depending upon the necessary visual distance which must be established utilizing the flag 26. In some instances, it may be preferred to seal the support 25 of the signal flag within the closure cap 22 by filling the cap with an epoxy or other sealant.

In order for the buoy to be effective for use in hours of darkness, the signal support tube 14 is generally hollow and provides a housing for a light source generally designated as 30. In the preferred embodiment, the light source 30 is a conventional chemiluminescent light source which may be activated by techniques such as twisting the plastic container in which the chemical components are separated from one another in order to allow them to become mixed to initiate a chemiluminescent light. In this manner, the closure cap 22 may be threadingly removed from the end of the support tube and thereafter the chemiluminescent light source deposited within the support tube. Light would then be provided during periods of darkness without the need for any electrical components being incorporated within the structure of the marker buoy. In some embodiments, it may be possible to use a small self-powered or battery powered penlight flashlight or the like which is inserted within the signal support tube, however, the chemiluminescent light source is preferred due to the durability of the source in an aqueous environment.

The marker buoy of the present invention is generally not designed to be light emitting over extremely long periods of time as the buoy is intended for use by individuals as opposed to being used by municipalities or governments to define channels. Therefore, the light source is generally provided for a single night's use with additional light sources being placed within the support tube as necessary in the event the buoy is to be retained in its deployed position.

In addition to the foregoing, although only one light support tube is shown in the drawings, it is possible that two or more support tubes could be utilized in series with the ends being threadingly connected and with the uppermost light support tube being capped by the closure member 22. In a like manner, the support tube 14 may be extended vertically by providing a separate tubular support member which would space the signal support tube in vertical relationship with respect to the float member 11.

As previously discussed, the float 11 is threadingly engagable with an anchor line dispensing assembly 17 in such a manner that the central axis of the float 11 extends generally through the central axis of the dispensing assembly as well as through the signal support tube 14. The anchor line dispensing assembly includes a housing 31 having substantially closed upper and lower walls 32 and 33 which are interconnected by integrally formed and spaced side walls 34 and 35. A pair of aligned openings are made through the side walls 34 and 35 for purposes of supporting a rotatable shaft 36 about which is supported the anchor line reel 37.

The anchor line reel 37 includes a pair of spaced flange members 38 and 39 having a collection spool 39 formed therebetween which spool is carried by the shaft 36. The flange 38 has a plurality of notches 40 formed therein so as to create a plurality of generally equally spaced radially extending teeth members 41 which are integral with the flange 38. Movement of the collection spool 39 may be manually adjusted utilizing a crank handle 45 which includes a mounting portion 46 having an opening 47 therein through which the extended end 48 of the shaft 36 may be selectively disposed. The shape of the opening 47 in the base of the handle 45 is such as to allow the handle to be frictionally received about the extended portion 48 of the shaft 46 so that the shaft may be manipulated by the crank handle. In some embodiments, it may be advisable to provide spring-loaded detents within the perimeter of the opening 47 in the crank handle in order to provide for further frictional engagement of the crank handle with the extension element 48 of the shaft 36. It is desired, however, that the crank handle be designed to be removable without the use of any tools from the extension 48 of the shaft so that the crank handle may be removed before the buoy or the anchor line 50 have been initially deployed so as to insure that the handle will not interfere with the rapid and continuous dispensing of the anchor line by retarding the spinning action of the spool 39.

The anchor line dispensing assembly of the present invention further provides a controlled dispensing tension and locking mechanism for preventing further deployment of the anchor from the spool of the assembly. In order to prevent the further discharge of line from the reel of the dispensing assembly, a bifurcated flexible plastic element 52 extends downwardly from the upper wall 32 of the anchor line dispensing housing and into the slots 40 which are created in the flange 38. The bifurcated element can be referred to as a clicker element which gives an audible indication of the play out or dispensing of the anchor line 50 from the reel as the spool is rotated. The two end portions of the element are flexible enough to be bent out of engagement with the flange 38 as the dispensing line is being discharged under the influence of an anchor or weight shown at 54. The flexibility of the bifurcated ends, however, is prevented if the ends thereof are prevented from flexing outwardly with respect to one another.

With this concept in mind, the locking assembly of the present invention 55 includes a pivotable locking arm 56 which surrounds the bifurcated ends of the element 52 and which has an outer portion that extends through a slotted opening in the side wall 35 of the housing 31. The locking arm 56 is shown in FIG. 3 as it is positioned in an anchor line dispensing position so that the end portion thereof which extends outwardly of the housing is in elevated relationship to the pivotable inner end 57 thereof which rotates about a support pin 58 which is secured to the upper wall 32 of the anchor line dispensing housing.

Figure 3:
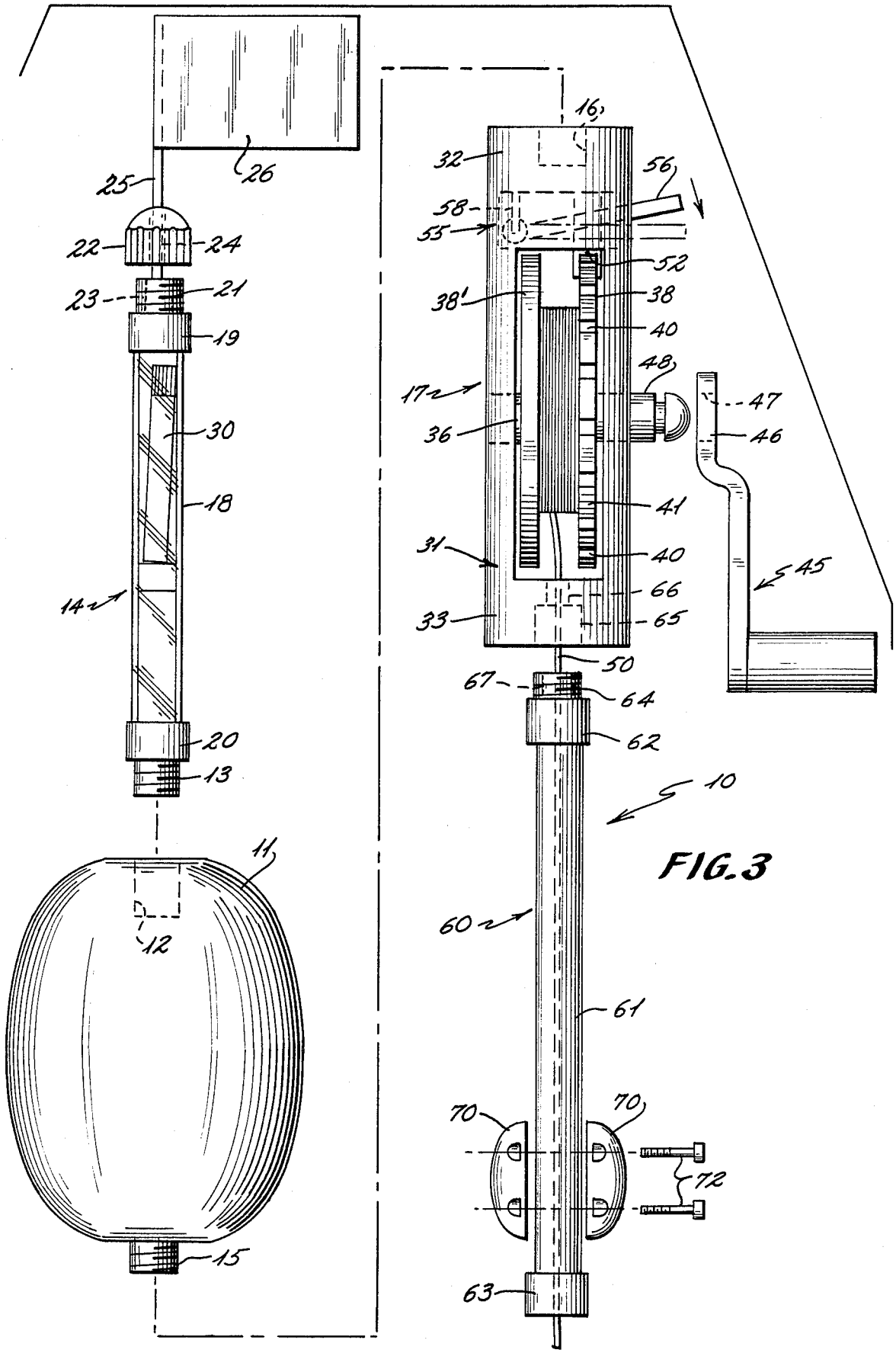
FIG. 3 is an enlarged assembly view of the buoy marker of the present invention showing the relative positioning of the major components thereof.

In the position shown in FIG. 3, as the anchor line is being discharged, the teeth 41 of the flange member 38 will cause the end or tip portions of the clicker element 52 to be deflected as the spool rotates allowing line to be dispensed. Once the anchor 54 has stopped its descent and there is no longer any application of weight or force along the anchor line 50, the rotation of the flange 38 will be stopped allowing the bifurcated ends of the clicker element to come to rest within one of the slots 40. In this position and without the spool being rotated, the locking arm 46 will fall by gravity to thereby retain the bifurcated ends of the clicker element from flexing outwardly with respect to one another. In this position, the bifurcated ends are not free to be yieldable to permit the rotation of the flange 38 and therefore lock the spool in a nondispensing position.

As previously discussed, the locking arm 56 surrounds the bifurcated clicking element so that portions of the locking arm extend on either side thereof. In this manner, both sides of the clicker element are surrounded and prevented from bending away from one another as the locking arm falls by gravity to the dotted line position shown in FIG. 3 to prevent further rotation of the anchor line reel.

When it becomes necessary to reel in the anchor line 50, once the crank handle 45 has been installed over the end portion 48 of the crank shaft 36, the locking arm 46 is raised within the slot in the side wall of the housing thereby allowing the spool to be rotated flexing the clicker element from one groove to another as the anchor line is rewound upon the spool. Once the entire line is rewound, the locking arm is again allowed to drop to its lower position whereby any further movement of the spool is prevented by restricting the flexible movement of the compressed ends of the bifurcated clicker element.

In order to vertically stabilize the float and the signal support means when the buoy is deployed, the portable marking buoy includes a buoyancy weight assembly which is secured and depends from the bottom wall 32 of the housing of the anchor line dispensing assembly. The buoyancy weight assembly 60 includes an elongated hollow housing or tubular member 61 which is preferrably formed of a sturdy plastic material and which has upper and lower capped end portions 62 and 63, respectively. The upper cap 62 includes a male threaded connector portion 64 which is selectively engagable within a female threaded socket 65 provided in the central portion of the lower wall 32 of the anchor line dispensing housing 31. In order to allow the dispensing line to pass from the anchor line dispensing assembly 17 and into the weight assembly 60, a first opening 66 communicates the anchor line dispensing assembly through a female socket 65 to an opening 67 through the male threaded end portion 64 of the buoyancy weight assembly 60. The anchor line is therefore cooperatively received through the anchor line dispensing housing and axially through the buoyancy weight assembly 60. The lower end cap 63 of the buoyancy weight assembly 60 also includes a small opening therein of a size which permits the anchor line to be extended therethrough but which prohibits the anchor or weight 54 to pass inwardly thereof.

Although the housing 61 of the buoyancy weight assembly 60 may be constructed so as to create its own weight, it is preferred that the tube be formed of a plastic material with the weight being applied by removable semi-circular weight elements 70 which are threadingly engaged with one another about the tube by pairs of screws 72. The weight is normally applied adjacent the lower end portion of the housing 61 so as to gain a mechanical advantage with respect to balancing the float and the signal support tube relative to the body of water in which the buoy is deployed. The amount of the weight may be varied as desired. In addition, as the weight does not constitute a moving part of the buoy apparatus, the weight may be formed of a number of given metallic materials.

From the foregoing description, it will be seen that the various components of the present invention are designed to be assembled along a common axis so that the stability of the portable buoy is insured whenever the buoy has been deployed In addition, as the anchor line dispensing assembly is mounted directly vertically beneath the float, there are no components thereof which extend outwardly a distance therefrom which could be engaged by passing marine craft which would otherwise avoid contact with the buoy even though coming in close proximity thereto.

The portable marker buoy of the present invention is designed to be generally maintenance free and corrosive resistant. In this regard, components thereof are primarily formed of plastic materials with the exception of the weights 70 and the anchor 54 as well as the locking arm 56 which may be formed of a stainless steel material. In a preferred embodiment, however, the locking arm 56 is also manufactured of a plastic material with a small weight being crimped to the end portion thereof which weight may be in the form of metallic material. The weight would therefore operate to drop the arm by gravity but would not effect the operation of the arm in the event that the weight becomes corroded.

When the portable marker buoy of the present invention is not in use, the component parts thereof are threadingly disassembled and may be easily stored in a satchel or bag and easily placed in a small compartment of a boat or water craft. When it becomes desirable to mark a particular point in a body of water, the marker buoy is readily assembled without the use of any tools by simply threadingly engaging the various components of the buoy in assembled relationship. As the components of the buoy are manufactured of plastic materials, the threads will not become corroded over a period of time, and therefore, the assembly may be easily disassembled even if the buoy may have been deployed over a prolonged period.

In assembling the portable marker buoy, the signal support tube 14 is threadingly engaged with the threaded receptacle 12 of the float 11. A suitable signal apparatus is thereafter supported within the support tube. The signal may either be in the way of a flag such as that shown at 26 having a flag post 25 extending through the upper cap 22 and into the support tube or may otherwise include a chemiluminescent or other light source shown at 30. The chemiluminescent light source may be applied by removing the cap 22 from the upper threaded portion of the signal support tube 14 and thereafter inserting the chemical light tube through the opening therein. The cap is thereafter replaced so as to retain the chemiluminescent light source in housed engagement within the tube. The opening in the cap 22 need not always be sealed in fluid tight arrangement as any water entering the signal support housing will not effect the operation of the chemiluminescent light source.

The anchor line dispensing assembly 17 is thereafter threadingly engaged with the float 11 so as to be in axial alignment therewith. The anchor line is extended through the opening 66 in the bottom portion of the anchor line dispensing frame or housing and is inserted through the tubular body portion of the weight assembly 60. The weight assembly 60 is thereafter threaded into engagement with the anchor line dispensing assembly and the anchor applied to the end of the anchor line. The marker buoy is now ready for deployment.

Prior to positioning the marker buoy in the water, the crank handle is removed and the locking arm 56 is raised to its upper position. The anchor is released at the same time that the marker buoy is placed in the water. As the anchor 54 descends through the water, the anchor line will be played out causing the spool 39 to rotate and thereby simultaneously rotating the flange element 38 of the dispensing assembly. As the flange 38 rotates, the bifurcated ends of the flexible element 52 will be deflected therefrom thereby preventing the locking arm 56 from dropping to its locked position. Once the anchor has completed its descent and there is no more tension on the anchor line, the spool will stop turning thereby preventing any further movement of the flange 38. At this time, the locking arm will drop by gravity preventing further rotation of the spool element of the dispensing assembly by causing the bifurcated clicker elements to be restricted and retained in a non-flexing orientation with respect to one another within the slots in the flange element 38.

When it is desired to retrieve the marker buoy from the water, the crank arm 54 is selectively engaged over the extension portion 48 of the shaft 36 which supports the collection spool. The locking arm is subsequently raised to permit the spool to be rotated without binding against the clicker elements 52. The control of the spool by using the clicker element not only provides a fool proof means for securing the reel from further movement once the anchor line is fully deployed, but the resistance provided by the flexible clicker elements during deployment will create a controlled release of the anchor line so as to prevent the spool from turning too fast and creating a potential backlash which would bind the anchor line within the dispensing assembly.

In the event that it is necessary to change the signal source, the buoy may be approached and the cap removed from the signal support housing, and thereafter, a separate light source or additional flag may be installed without having to remove the buoy from the water.

I claim:

1. A portable marker buoy apparatus comprising a float means having upper and lower ends and a generally central vertical axis, an anchor line dispensing means including a frame member having upper and lower connector portions, said upper connector portion being removably mounted to said lower end of said buoy so that said anchor line dispensing means is in substantial axial alignment therewith, said anchor line dispensing means including a reel assembly rotatably carried by said frame member, an anchor line normally wound around said reel assembly, control means carried by said frame member for restricting the rotation of said reel assembly with respect to said frame member to control the deployment of said anchor line therefrom, said reel assembly including a central spool having at least one annular flange extending perpendicular thereto, said annular flange having a plurality of notches formed in generally equally spaced relationship around the outer periphery thereof, said control means including generally flexible latch means having an outer end, means for mounting said latch means to said frame member so that said outer end thereof extends downwardly into said notches in said one of said annular flanges, said outer end of said latch means being flexible to permit controlled rotation of said reel assembly, an elongated tubular weight assembly removably mounted to said lower connector portion of said frame member of said anchor line dispensing means so as to be generally axially aligned with and spaced from said float means, said anchor line extending through said weight assembly, at least one elongated vertically extending pole means mounted to said upper end of said float means and extending generally axially thereto, a signal means carried by said pole means.

2. The portable marker buoy of claim 1 in which said pole means has upper and lower ends and is generally hollow and cylindrical having a transparent side wall, and light means removably housed within said pole means.

3. The portable marker buoy of claim 2 including cap means for closing said upper end of said pole means, and marker means carried by said cap means and extending generally above said pole means.

4. The portable marker buoy of claim 3 in which said light means is a chemiluminescent light tube.

5. The portable marker buoy of claim 2 wherein said latch means includes bifurcated outer ends, a locking lever, said locking lever having a first end surrounding said latch means and a second end extending through a vertical slot in said frame member, said locking lever being slideable with respect to latch means and said vertical slot whereby when said locking lever is raised vertically to a first position, said bifurcated ends of said latch means are flexible to permit controlled rotation of said spool and when said locking lever is lowered to a second position, said bifurcated ends of said latch means are retained in relatively fixed relationship to one another to thereby prevent additional rotation of said central spool, said locking lever automatically assuming said second position by gravity when said central spool is not rotating.

6. The portable marker buoy of claim 2 in which said reel assembly includes a crankshaft having first and second end portions rotatably supported by said frame member, said central spool being carried by said crankshaft, and handle means removably supported by said first end portion of said crankshaft whereby said handle means may be selectively attached to said crankshaft to manually wind said anchor line about said central spool and is removable to prevent the unauthorized manipulation of said anchor line.

7. The portable marker buoy of claim 1 including an opening in said lower connector portion of said frame member through which said anchor line extends, said weight assembly having upper and lower ends, said upper end of said weight assembly being selectively receivable within said opening in said lower connector portion of said frame member so that said anchor line extends therethrough and weight means removably mounted to said tubular weight assembly.

8. The portable marker buoy of claim 7 including second cap means removably secured to said lower end of said weight assembly, an opening through said second cap means through which said anchor line extend and anchor weight means secured to said anchor line exteriorly of said second cap means, said opening in said second cap means being of a size to prevent said anchor means from passing therethrough.

9. The portable marker buoy of claim 8 in which said pole means, said float means, said reel assembly and said weight assembly are directly threadingly secured to one another so that the marker buoy is selectively disassembled for storage without the use of tools.

* * * * *